US005709920A

United States Patent [19]

Danton

[11] Patent Number: 5,709,920

[45] Date of Patent: Jan. 20, 1998

[54] STRUCTURE OF SEAT COVERS WHICH IS CAPABLE OF WITHSTANDING LACERATIONS, AND METHOD FOR THE MANUFACTURE THEREOF

[75] Inventor: Jean-Louis Danton, Boulogne, France

[73] Assignee: Etablissements Duret, Brionne, France

[21] Appl. No.: 583,494

[22] Filed: Jan. 5, 1996

[30] Foreign Application Priority Data

Jan. 6, 1995 [FR] France ..... 95 00113

[51] Int. Cl.[6] ..... B32B 1/04

[52] U.S. Cl. ..... 428/68; 428/102; 428/195

[58] Field of Search ..... 428/68, 102, 195

[56] References Cited

FOREIGN PATENT DOCUMENTS

12027/88 8/1988 Australia .

0201419 12/1986 European Pat. Off. .

3702639 1/1987 Germany .

2204235 4/1988 United Kingdom .

*Primary Examiner*—Helen Lee

*Attorney, Agent, or Firm*—Scully, Scott, Murphy & Presser

[57] ABSTRACT

In this cover structure, the reinforcing is formed by strips (1) or wires which are spaced from one another, of a material which is capable of providing resistance to the passage of a sharp object, each strip or wire having a meandering configuration formed by curved patterns and/or by patterns comprising regularly repeated rectilinear segments (2, 3), similar patterns of the various strips or wires being disposed in a manner such that they are juxtaposed or fit into one another in corresponding positions, such that each strip or wire is spaced from the adjacent strips or wires with a spacing such that a cutting object driven along a rectilinear path will, of necessity, encounter a strip or a wire in every direction on its path. See FIG. 1A.

10 Claims, 5 Drawing Sheets

STRUCTURE OF SEAT COVERS WHICH IS CAPABLE OF WITHSTANDING LACERATIONS, AND METHOD FOR THE MANUFACTURE THEREOF

The present invention relates to a structure for seat covers, in particular for seats in public transport vehicles, which is capable of withstanding lacerations. The invention also relates to a method for the manufacture of such structures.

It is known that seats used in public places, and in particular in urban and suburban public transport means, are increasingly frequently becoming the target of acts of vandalism and are, in particular, frequently subjected to lacerations using sharp objects.

Over the years, these malicious acts have assumed such proportions that various companies, specializing in this technique, have been induced to propose seat upholstery capable of withstanding lacerations (see, in particular, FR-A-2 447 167 and FR-A-2 530 440, in the name of the Applicant, or FR-A-2 576 200 in the name of the company SOFANOR).

In the case of the earlier upholstery of the Applicant, the element which resisted the action of a cutting object was formed by a sheet of helical springs, partially embedded in an elastomer foam which, in turn, adhered to a layer of a solid elastomer. The helical springs, however, presented a satisfactory flexibility in one direction only. In addition, the requirement for the sheet of springs to be partially embedded in a relatively thick elastomer layer caused the manufacture of this lining to be rather complicated and, consequently, relatively costly.

FR-A-2 576 200 proposes, with the same objective, a textured fabric of metal threads placed between two layers of a flexible material. The textured fabric of metal wires has the advantage that it presents a considerable flexibility in all directions, but, on the other hand, the shape of the meshing makes it impossible to use metal threads having an adequate diameter to resist a severe laceration effectively.

The object of the present invention is to provide a structure for seat covers which does not have the drawbacks mentioned above.

More particularly, the object of the invention is to provide a structure for a seat cover which effectively resists acts of laceration, which is flexible in all directions and which may be manufactured by simple methods, a reduced cost relative to the prior art linings.

To this end, the present invention relates to a structure for a seat cover capable of withstanding lacerations, of the type comprising a sheet of flexible material which is lined by a reinforcing backing, characterized in that the reinforcing backing is formed by strips or wires, which are spaced from one another, of a material which is capable of providing resistance to the passage of a sharp object, each strip or wire having a meandering configuration formed by curved patterns and/or by patterns comprising regularly repeated rectilinear segments, similar patterns of the various strips or wires being disposed in a manner such that they are juxtaposed or fit into one another in corresponding positions, such that each strip or wire is spaced from the adjacent strips or wires with a spacing such that a cutting object driven along a rectilinear path will, on its path, of necessity encounter a strip or a wire in every direction, said strips or wires either being independent of one another or joined transversely by means of stays which are integral with said strips or wires, and forming an integral part of the sheet of flexible material by means of at least one coat of adhesive matter or plastics matter, in which said strips or wires are at least partially embedded.

Corresponding parts of the adjacent strips or wires may, advantageously, be equidistantly spaced from one another.

It is possible for a decorative covering sheet (weaving, textile, leather, etc.) to be joined integrally to the surface of the coat of adhesive matter or plastics matter, but not integral with the sheet of flexible material.

Alternatively, it is possible for a decorative covering sheet to be substituted for the sheet of flexible material, to serve, in its place, as support for the strips or wires.

The strips or wires of the sheet according to the invention have the significant characteristic that they do not overlap or intertwine, neither are they interlinked by additional elements in the manner of lattice work, or a woven or knitted fabric. Once they have been pre-shaped in the desired pattern, they may simply be placed in parallel on the surface of the flexible sheet which has first been coated with an adhesive matter or a resin, the polymerization of which is subsequently carried out, either strip by strip or wire after wire, when the strips or wires are separate from one another, or in the form of a single framework if the strips or wires are transversely joined to one another, for example by means of stays forming an integral part of said strips or wires.

Accordingly, the invention also relates to a method for the manufacture of a structure for a seat cover which is capable of withstanding lacerations, said method being characterized in that a first coat of an adhesive matter or of a resin, which is capable of polymerizing, is applied on to a surface of a sheet of a flexible material, in that, subsequently, strips or wires which are spaced from one another and are of a material which is capable of providing resistance to the passage of a sharp object, are applied on to this same surface, each strip or wire having a meandering configuration formed by curved patterns and/or by patterns comprising regularly repeated rectilinear segments, the various strips or wires being disposed on the sheet of flexible material in a manner such that the similar patterns of the various strips or wires are juxtaposed or fit into one another in positions such that each strip or wire is spaced from the adjacent strips or wires with a spacing such that a cutting object driven in a straight movement will, on its path, of necessity encounter a strip or a wire in every direction, in that a second coat of an adhesive matter or a resin capable of polymerizing is possibly subsequently applied, and in that the adhesive matter is left to harden or the resin is left to polymerize, in order to secure the strips or wires in position.

As indicated above, the strips or wires may be applied on to the flexible sheet either independently of one another or in the form of a single framework, depending on whether they are separate or are joined together transversely by means of stays which form an integral part of said strips or wires.

The strips or wires must, of course, have an adequate flexibility to permit the component of the cover thus formed to be freely deformed. In particular when the strips or wires are independent of one another, the cover structure is provided in the form of a sheet which may, advantageously, be rolled up in order to store it prior to use. The strips or wires may be of metal and/or a plastics material, possibly reinforced.

If the strips or wires are joined to one another, they form a monobloc structure which may, accordingly, be manufactured at the dimensions required for the part of the seat to be provided with the cover structure, without any waste in material resulting from subsequently cutting to the dimensions. This would be the case, in particular, for cover structures comprising strips which are joined next to one another by means of stays, which form a framework which may be punched out in a single operation to the desired dimensions, the non-punched peripheral edges of which form a relatively rigid frame which simplifies applying the invention. The cover structure thus provided constitutes a preferred embodiment of the invention.

In addition, it is possible for a structure of this kind, in which the strip or the wires form a monobloc structure, itself to form part of a seat, for example the back of a seat, which is readily attached to the frame of the seat.

A further significant advantage of a monobloc structure of this kind resides in the fact that, in the event that a strip should break, it does not have the tendency to protrude out of the upholstery. On the contrary, due to the flat shape of the strips, if one should accidentally break, it remains within the upholstery, where it is kept in place by the other components of the upholstery (for example, the elastomer layer and decorative fabric). The capacity of the upholstery to withstand lacerations is thus not affected by the breaking of one or more strips of the reinforcing structure.

As will be shown by the detailed description which will be given hereinafter, with reference to the attached drawings, numerous configurations may be provided for the strips, wires or the like of the lining component according to the invention, starting with simple sinusoidal patterns up to configurations formed by repetitive patterns formed by right-angled segments similar to the steps of a staircase, crenellated configurations or in Greek boustrophedon configurations.

In a preferred embodiment of the invention, the backing is formed by punched out independent strips placed in a contiguous position from a sheet of a material which is resistant laceration, in particular a metal sheet. In fact, as will be seen hereinafter, it is possible to cut a plurality of strips of the same shape from a sheet metal strip which is unwound from the same roll, leaving next to one another the ends of strips corresponding to the ends of the unwound sheet metal strip, which subsequently permits, in readiness for use, to roll up the sheet metal strip in which the strips are pre-cut and next to one another. When the strips are applied on to the sheet of flexible material, all that is required is for the strips to be separated from each other at their ends. It is possible, advantageously, during manufacture, to maintain intermediate links between the strips, for example at two or three points, at regular intervals between the ends, in order to facilitate the rewinding of the ribbon with the pre-cut strips. These links may, if required, be removed when the strip is placed in position on the flexible sheet.

This may be of any appropriate material: woven fabric, non-wovens, felt, canvas, plastics film or even tapestry to form the outer surface of the seat component, as indicated above.

It is advantageously possible to use silicone-based glues in order to join the flexible sheet firmly to the strips or wires.

Two coats of adhesive matter are preferably used: a first coat is applied directly on to the flexible sheet, on to which the strips or wires are to be placed, and a second coat on to the strips or wires, in a manner so as to cover them completely, in order to provide a greater degree of adhesion between the various components and to protect the strips or wires.

It is also possible to apply the strips or wires to the sheet of flexible material without the latter first having been coated with a coat of adhesive matter or of polymerizable resin, and to apply to said strips or wires a sheet of a thermoplastic material which is subsequently brought to its softening or melting temperature.

In the case of strips which are cut from a sheet metal strip, the strips may have a thickness of 0.2 to 1 mm and a breadth of about 1 to 20 mm, so as to provide sufficient resistance to laceration and, in that case, the various strips are spaced at about 5 mm from one another. It is also possible to use thinner but broader strips, in order to increase the flexibility of the cover sheet and to permit, for example, that the latter can be rolled up both in the general direction of the strips and in a perpendicular direction. To this end, it is also possible to use plain or reinforced plastics materials, or glass fibre reinforced, carbon fibre reinforced, or kevlar™ fibre reinforced composite materials, etc.

In the case of metal wires having a circular cross-section, their diameter may be between 0.6 and 1.2 mm, and it is possible to provide approximately 100 wires per metre of sheet, in a transverse direction relative to the overall direction of the wires.

The attached diagrammatic drawings illustrate various embodiments according to the invention. In these drawings.

Figure 1A:
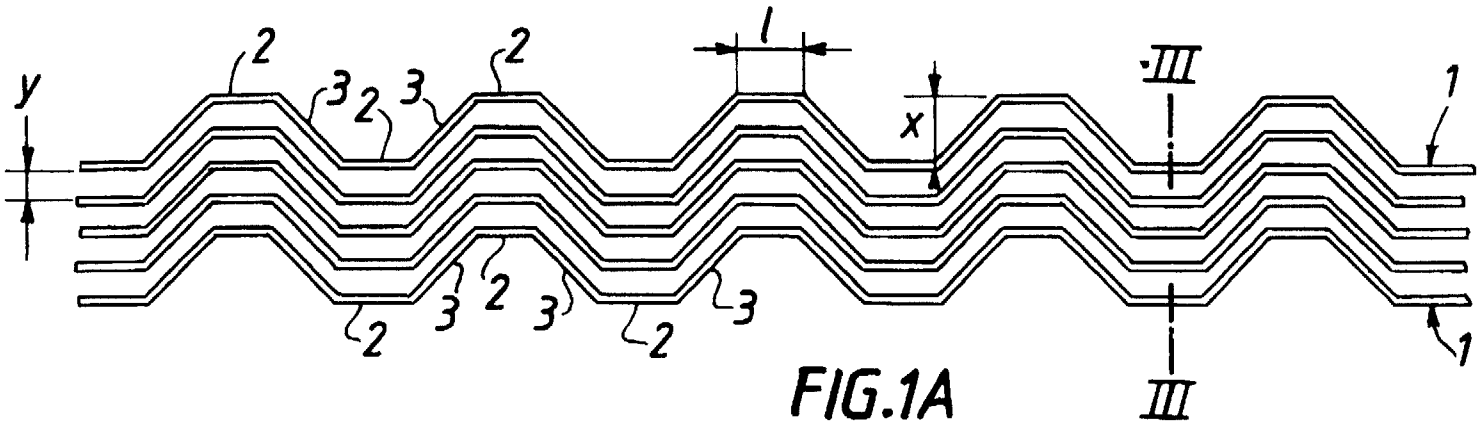
FIG. 1A shows a first strip configuration for possible use, applied to a flexible sheet having a structure according to the invention.
Figure 1B:
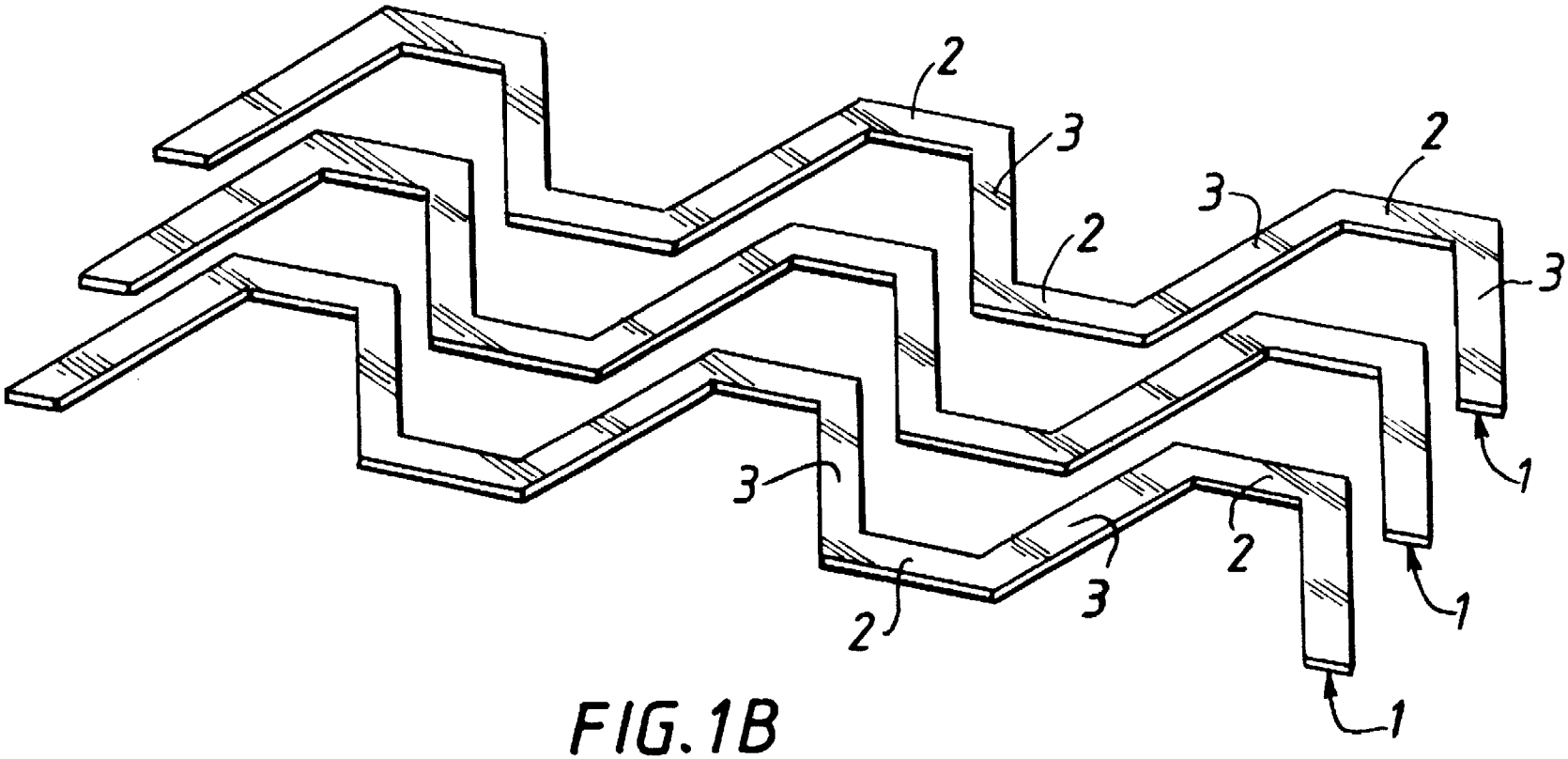
FIG. 1B is an enlarged perspective view of the strips of FIG. 1A.

In the embodiment of the invention according to FIG. 1, the strips 1 of a material which is resistant to laceration are formed by an alternating succession of rectilinear segments 2, of identical breadth and parallel to one another, and rectilinear segments 3, also of identical breadth and inclined by 135° relative to the first segments. The segments 2 and 3 thus form successive inverted trapezoidal configurations, the unit possibly being regarded as an approximately sinusoidal configuration formed by rectilinear parts. The segments 2 and 3 of the various strips are parallel to their counterparts in the other strips, such that the various trapezoidal configurations fit into one another with a uniform spacing therebetween, in a manner such that they are capable of resisting, in any direction, a sharp object which is moved in a straight line and thereby preventing a deep laceration of the cover sheet.

Figure 3:
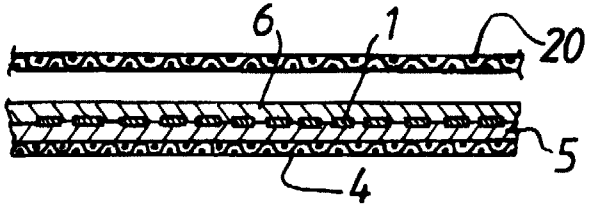
FIG. 3 is a cross-section along line III—III of FIG. 1 of the strips, of the supporting sheet and of the cover sheet.

In the present embodiment, the various strips 1 are independent of one another, i.e. they are not joined transversely by additional parts to form a lattice structure, or a meshed or woven structure, and they are not firmly connected by stays integral therewith. As shown in FIG. 3, they are simply applied to a flexible sheet 4, for example a fabric, which is first coated with a first adhesive coat 5, and they are subsequently preferably covered by a second adhesive coat, interconnecting them in a simple and effective manner with the fabric 4, on to which may be applied a sheet of upholstery 20 which will constitute the outer surface of the seat component which is to be provided with this cover structure. As indicated above, the upholstery sheet 20 or the like may possibly be substituted for the flexible sheet 4, to be used as direct support means for the strips 1. Instead of the adhesive matter 6, it is also possible to use a resin of a polymerizable material, or to apply a sheet of thermoplastic material on to the strips subsequently to heat this to its softening or melting temperature.

In the embodiment according to FIG. 1, the rectilinear segments 2 of a strip may have a length 1 of about 10 mm and may be distant from the parallel segments 2 of the same strip by a uniform distance x of 5 mm. The spacing y of the segments of a strip from the corresponding and parallel segments of an adjacent strip will be 5 mm.

Figure 2:
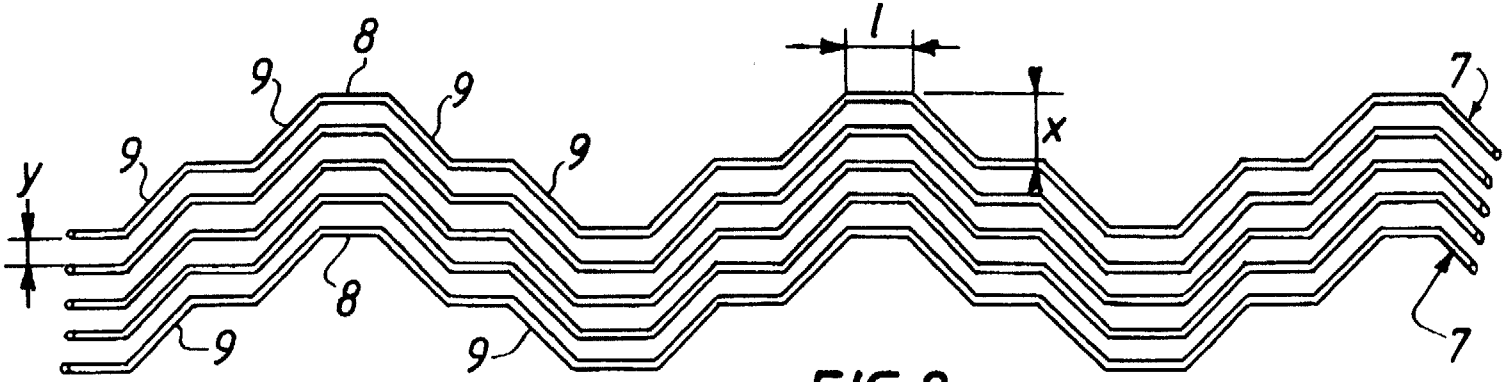
FIG. 2 shows a different configuration of the strips.

In the modified embodiment of FIG. 2, each strip 7 is formed, once again, by rectilinear segments 8 which are parallel to one another and of the same breadth, and segments 9 which are also of the same breadth, but extend at an inclination of 135° relative to the first-mentioned segments. In this case, each strip comprises, successively, two parallel segments 8 which alternate with two parallel segments 9, which are inclined at 135° relative to the first-mentioned segments.

In this embodiment, the strips 7 have a cumulative length (the sum of the lengths of the sections 8 and 9) which is greater than the length of the strips 1 of FIG. 1, and it accordingly provides a greater degree of flexibility. In this embodiment, it is possible for the lengths 1 and the distance x and the spacing y to have the same values as in the embodiment of FIG. 1, i.e. 10 mm, 10 mm and 5 mm, respectively.

Figure 5:
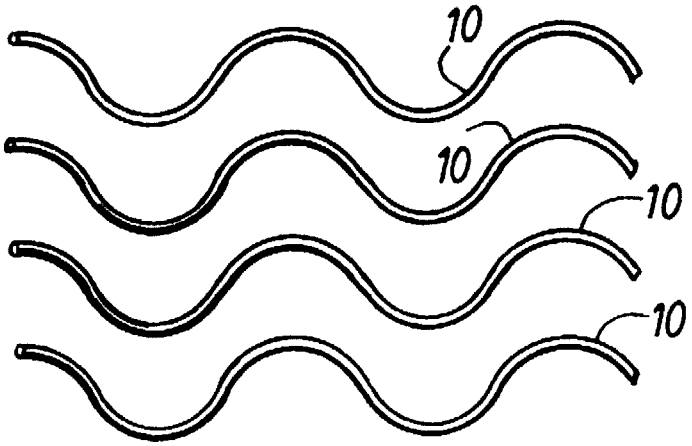
FIG. 5 shows a configuration of wires which may be used in a sheet according to the invention.

It is, of course, possible for the strips of FIGS. 1 and 2 to be replaced by wires 10 having a round or oval cross-section, taking the form, for example, of substantially sinusoidal configurations as shown in FIG. 5.

Figure 4:
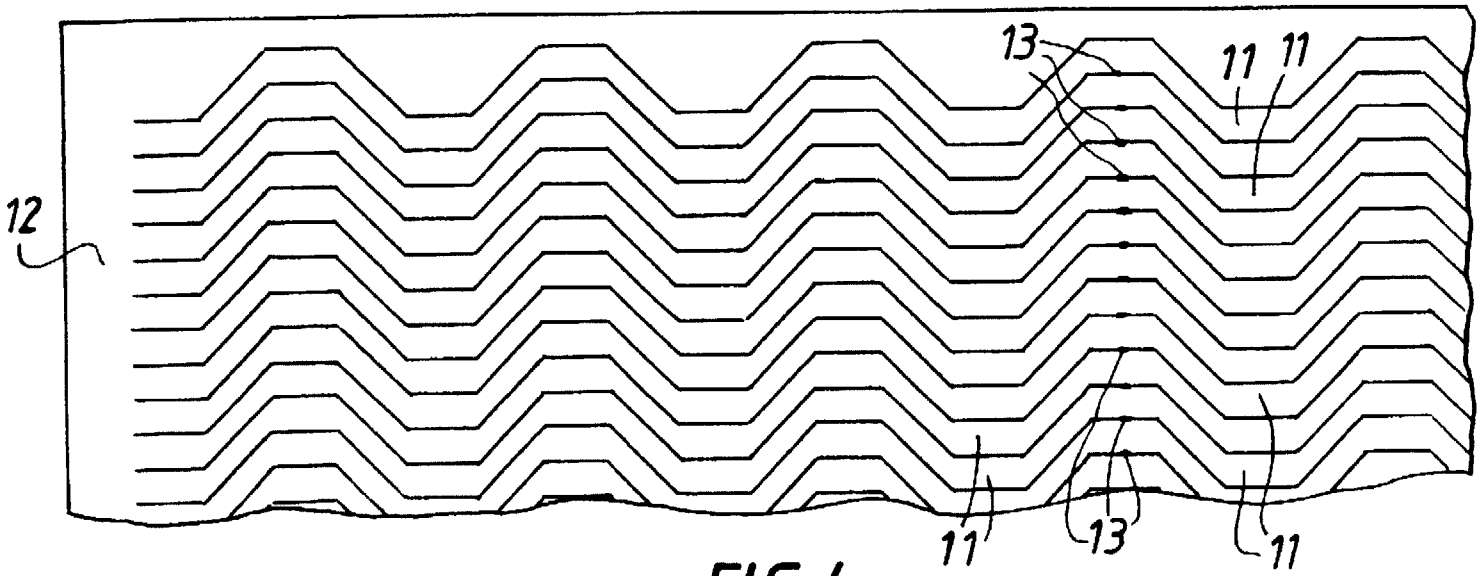
FIG. 4 shows the manner in which the strips of FIG. 1 are cut in a single sheet which is unwound from a roll, in a manner such that they may be rolled up on to the roll again.

Strips are, however, preferred because, as explained above and as shown in FIG. 4, they are readily punched out of one and the same sheet metal strip unwound from a roll, adjacent strips remaining joined, via regions not punched out 12, at the ends of the sheet metal strip, and via lateral links 13 at uniformly spaced points between the ends, which arrangement permits a rewinding of the punched sheet metal strip and the ready storing thereof in the form of a roll. The links 12 and 13 may be removed, if required, prior to positioning the strips on a sheet of flexible material and tightly joining the strips thereto.

Figure 6:
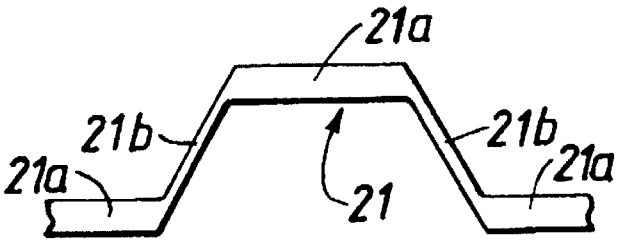
FIGS. 6 to 10 show other configurations of strips which may be independent or may form part of a monobloc framework, which may be used within the frame of the invention.

The strips illustrated in FIGS. 1 to 4 have a breadth which is constant along their entire length, but it is also possible for the breadths to vary, as shown in FIG. 6, in which the strip 21 comprises rectilinear segments 21*a* and 21*b* having different breadths.

As explained above, it is possible for the strips of the structure according to the invention to be applied independently of one another on to the flexible sheet, to which they are tightly connected, but it is also possible for said strips to form a monobloc framework, punched out from a sheet having the dimensions of the seat component, thereby reducing wastage and losses in raw material.

Figure 7:
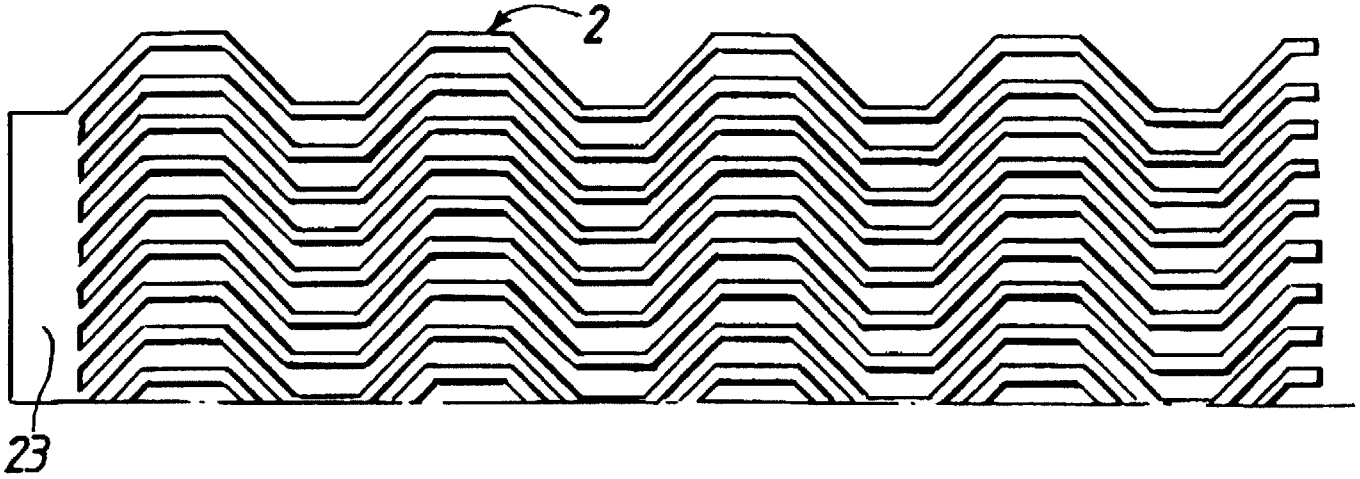

In the framework structure of FIG. 7, the same strips 2 as in FIG. 1A will be seen, having been, for example, punched out, in one and the same rectangular panel, the lateral ends of which are joined together in two parallel edges 23 which are not punched out of this sheet.

Figure 8:
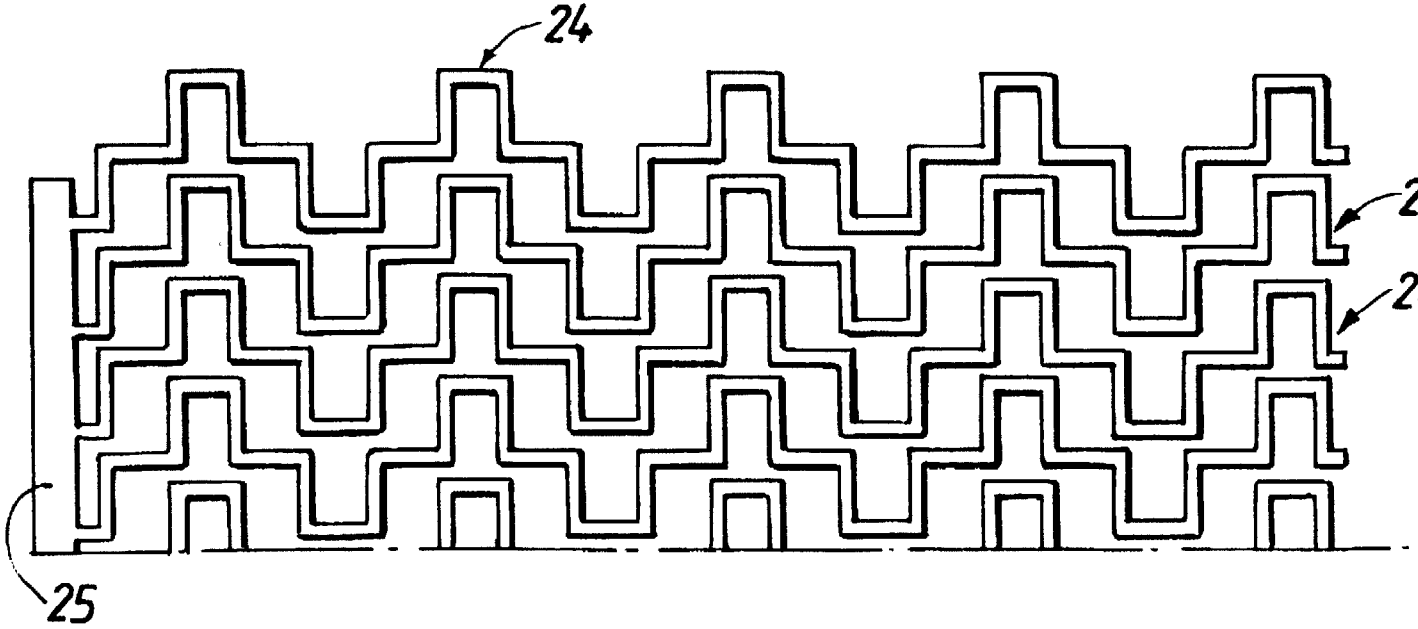

The same applies in the case of the framework structure of FIG. 8, in which the strips 24 have a crenellated configuration formed by rectilinear segments which are perpendicular with respect to one another, and are juxtaposed in a contiguous position in a manner such that they constitute an obstacle to the passage of a blade. As in the case of the framework structure of FIG. 7, the strips 24 are punched out of one and the same rectangular sheet which has the dimensions of the seat component to be provided therewith, and the ends are joined at two parallel edges 25 which are not punched out of this sheet.

Figure 9:
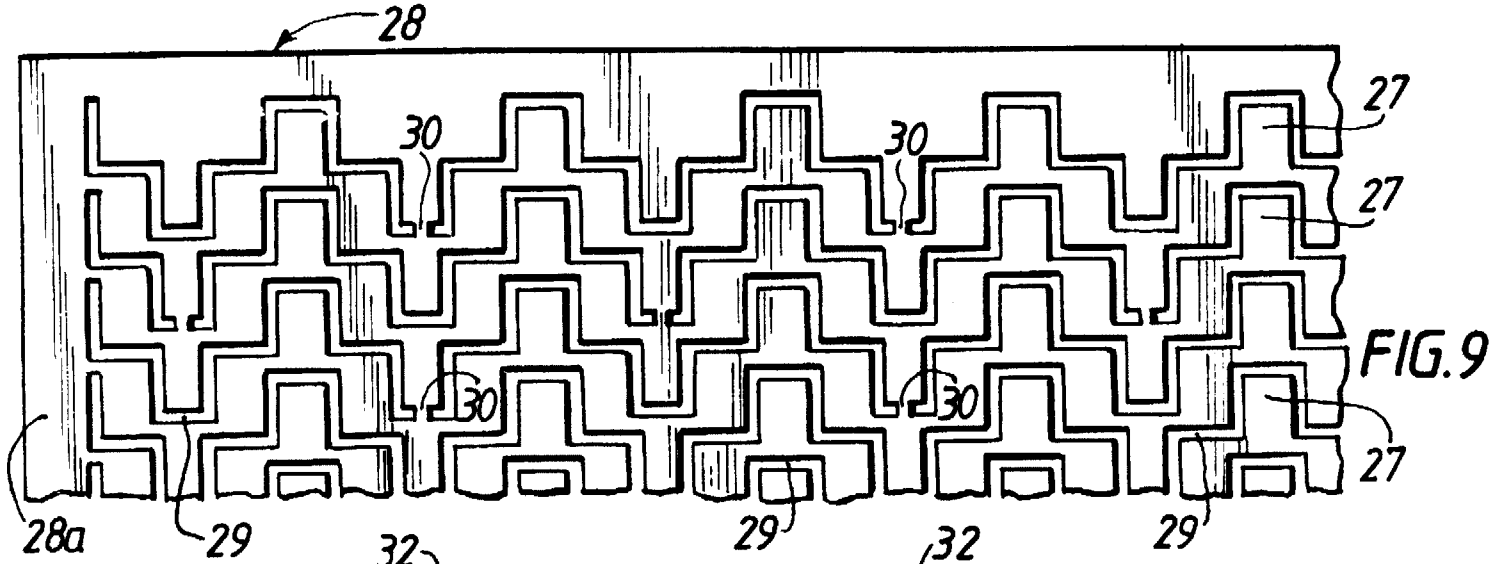

In the embodiment of FIG. 9, the strips 27 are also punched out of a sheet 28 and are separated by punched out regions 29 of a crenellated configuration similar to the configuration of the strips 24 of FIG. 8. The ends of the strips 27 are joined together at two parallel edges 28*a* of the sheet 28. In addition, the various strips are interlinked by transverse stays 30 which interrupt the punched-out regions 29 at regular intervals.

Figure 10:
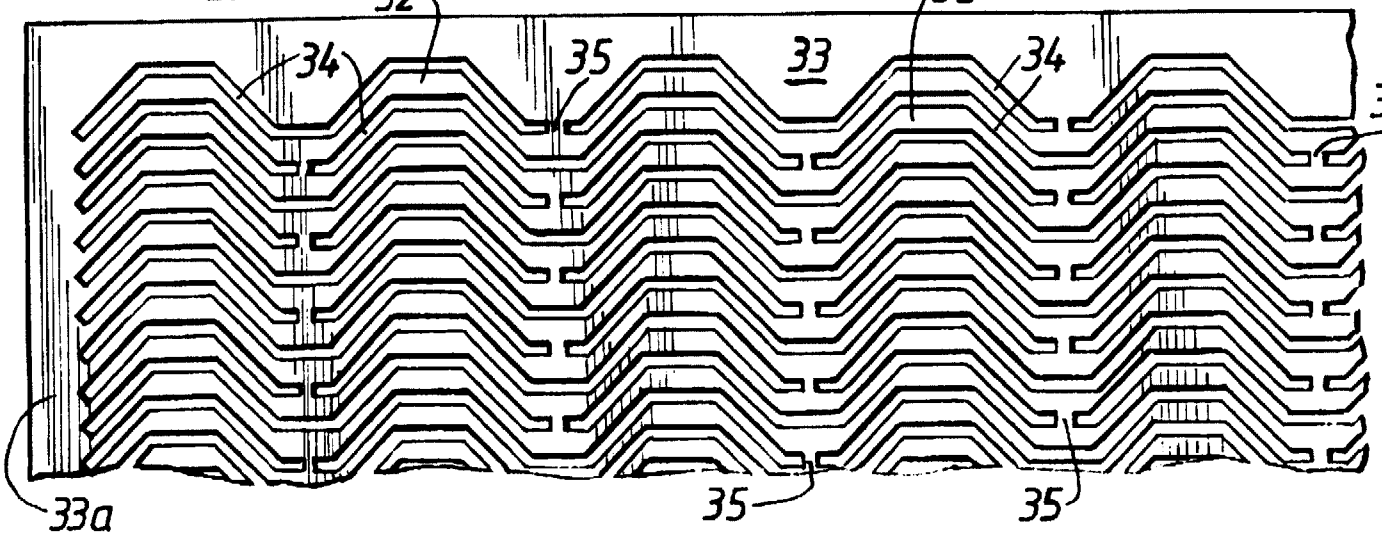

Likewise, in the embodiment of FIG. 10, the strips 32 which have a configuration similar to that of the strips of FIG. 6, are punched out of a sheet 33 and their ends are joined together at two opposite edges 33*a* of said sheet. The strips 32 are separated by gaps 34 which have a shape similar to the configuration of the strips of FIG. 1 and they are joined at regular intervals to the adjacent strips by transverse stays 35 which interrupt the gaps 34.

The strips which are described above as forming an integral part of a sheet may, of course, be provided and used in an independent form in a framework structure according to the invention.

The configurations of the strips or wires described above are, of course, not of a limiting nature and a person skilled in the art may conceive other configurations without exceeding the scope of the invention.

It is evident that the structures according to the invention, due to the repeated configuration of the strips or wires contained in said structures and the great number of said strips, preferably disposed with a uniform spacing therebetween, in an effective manner oppose deep lacerations of the seats equipped therewith. It is also evident that these structures are very flexible which, in certain embodiments (for example, those of FIGS. 1, 2, 5 and 6) permits that they be rolled up both in the direction of the strips or wires contained therein and in the perpendicular direction.

These structures may be used to cover all parts of a chair, namely both the seat itself, whether it is an easy chair, a couch or a bench, and the backrest or the armrests.

The invention thus provides a simple and effective means to protects seats, in particular seats for use in public places and, in particular, in public transport means.

I claim:

1. Structure for a seat cover adapted to withstand lacerations, including a sheet (4) of flexible material which is lined by a reinforcing backing, said backing comprising a plurality of strips (1, 7, 21, 24, 27, 32) or wires (10), which are spaced from one another and being constituted of a material which is capable of providing resistance to the passage therethrough of a sharp object, each said strip or wire having a meandering configuration selectively formed by curved patterns and by patterns consisting of regularly repeated rectilinear segments (2, 3; 21*a*; 21*b*; 8,9), similar patterns of the various strips or wires being disposed in a manner such that they are juxtaposed to fit into one another in imbricating non-intermeshing positions, such that each said strip or wire is spaced from adjacent said strips or wires at a spacing such that a cutting object driven along a rectilinear path will along the path of movement thereof encounter a strip or a wire in every direction, said strips or wires being selectively independent of one another or joined transversely by stays which are integral with said strips or wires, and being firmly joined to the sheet (4) of flexible material by at least one coat (5, 6) of an adhesive or a plastic composition into which said strips or wires are at least partially embedded.

2. Structure according to claim 1, wherein the patterns of the strips (1) or wires (10) have a sinusoidal configuration.

3. Structure according to claim 2, wherein the strips (1, 7) comprise first parallel rectilinear segments (2, 8) which are joined by second rectilinear segments (3, 9) which are disposed obliquely with respect to the first parallel segments.

4. Structure according to claim 3, wherein the strips each possess a uniform width along the entire length thereof.

5. Structure according to claim 3, wherein the rectilinear segments (21*a*, 21*b*) of the strips (21) each have varying widths.

6. Structure according to claim 1, wherein the strips (24) each have a crenellated configuration comprising rectilinear segments which are disposed perpendicularly with respect to one another.

7. Structure according to claim 1, wherein the strips (27) are separated by gaps which have a crenellated configuration and comprise rectilinear portions which are disposed perpendicularly with respect to one another.

8. Structure according to claim 1, wherein corresponding portions of adjacently located strips or wires are separated in a uniform spacing.

9. Structure according to claim 1, wherein said plurality of strips or wires form a monoblock unit having the dimensions of a seat component which is to be equipped with said structure.

10. Structure according to claim 9, wherein the plurality of strips (2, 24, 27, 32) are cut in a plate from a roll having substantially the dimensions of the seat component and have ends adjacent to two opposite uncut edges (23, 25, 28*a*, 33*a*) of the plate.

* * * * *